US008262464B2

(12) United States Patent
Canterbury et al.

(10) Patent No.: US 8,262,464 B2
(45) Date of Patent: Sep. 11, 2012

(54) PARTIALLY-POWERED WAGERING GAME MACHINES

(75) Inventors: Stephen A. Canterbury, Antioch, IL (US); Victor Mercado, Berwyn, IL (US)

(73) Assignee: WMS Gaming Inc., Waukegan, IL (US)

( * ) Notice: Subject to any disclaimer, the term of this patent is extended or adjusted under 35 U.S.C. 154(b) by 240 days.

(21) Appl. No.: 12/812,899

(22) PCT Filed: Jan. 26, 2009

(86) PCT No.: PCT/US2009/000490
§ 371 (c)(1),
(2), (4) Date: Jul. 14, 2010

(87) PCT Pub. No.: WO2009/097103
PCT Pub. Date: Aug. 6, 2009

(65) Prior Publication Data

US 2011/0053679 A1 Mar. 3, 2011

Related U.S. Application Data

(60) Provisional application No. 61/023,921, filed on Jan. 28, 2008.

(51) Int. Cl.
*A63F 9/24* (2006.01)

(52) U.S. Cl. ..... 463/24

(58) Field of Classification Search ..... 463/24
See application file for complete search history.

(56) References Cited

U.S. PATENT DOCUMENTS 4,583,170 A 4/1986 Carlin et al.
4,614,342 A 9/1986 Takashima
4,782,468 A 11/1988 Jones et al.
4,930,062 A 5/1990 Yamada
5,036,261 A 7/1991 Testin
5,221,083 A 6/1993 Dote
5,742,514 A 4/1998 Bonola
5,835,780 A 11/1998 Osaki et al.
5,995,387 A 11/1999 Tajahashi et al.
6,154,845 A 11/2000 Iikbahar et al.
6,181,114 B1 1/2001 Hemena et al.
6,201,703 B1 3/2001 Yamada et al.
6,575,833 B1 6/2003 Stockdale
6,641,483 B1 11/2003 Luciano et al.
6,699,128 B1 3/2004 Beadell et al.
6,804,763 B1 10/2004 Stockdale et al.
6,896,620 B1 5/2005 Luciano et al.

(Continued)

OTHER PUBLICATIONS

"International Application Serial No. PCT/US2009/000490, International Search Report mailed Mar. 3, 2009", 4 pgs.

(Continued)

*Primary Examiner* — Pierre E Elisca

(74) *Attorney, Agent, or Firm* — Schwegman Lundberg & Woessner, P.A

(57) ABSTRACT

Apparatus, systems, and methods may operate to receive an indication that a wagering game machine is to enter into a service power mode while the game machine is fully operational, and then to enter into the service power mode to disable game play while providing substantially uninterrupted power to a subset of game machine components. These powered components include one or more processors and memory. The service power mode may operate to leave the remainder of the game machine components unpowered, so that later transitioning from the service power mode to full operation does not result in resetting the processors. Other apparatus, systems, and methods are disclosed.

20 Claims, 4 Drawing Sheets

U.S. PATENT DOCUMENTS

| | | | | |
|---|---|---|---|---|
| 7,066,816 | B2 | 6/2006 | Gauselmann et al. | |
| 7,736,234 | B2 * | 6/2010 | Cockerille et al. | 463/43 |
| 7,862,435 | B1 | 1/2011 | Schreiber | |
| 2003/0064815 | A1 | 4/2003 | Burnside et al. | |
| 2004/0142753 | A1 | 7/2004 | Beadell et al. | |
| 2005/0262242 | A1 | 11/2005 | Byers et al. | |
| 2006/0205515 | A1 * | 9/2006 | Cockerille et al. | 463/43 |
| 2012/0058816 | A1 * | 3/2012 | Wells | 463/25 |
| 2012/0064978 | A1 * | 3/2012 | Wells | 463/42 |

OTHER PUBLICATIONS

"International Application Serial No. PCT/US2009/000490, Written Opinion mailed Mar. 3, 2009", 7 pgs.

* cited by examiner

PARTIALLY-POWERED WAGERING GAME MACHINES

RELATED APPLICATION

This patent application is a U.S. National Stage Filing under 35 U.S.C. 371 from International Patent Application Serial No. PCT/US2009/000490, filed Jan. 26, 2009, and published on Aug. 6, 2009, as WO 2009/097103 A1, which claims the priority benefit of U.S. Provisional Patent Application Ser. No. 61/023,921 filed Jan. 28, 2008 and entitled "PARTIALLY-POWERED WAGERING GAME MACHINES", the contents of which are incorporated herein by reference in their entirety.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2008, 2009 WMS Gaming, Inc.

BACKGROUND

Today's wagering game machine may include a computerized system controlling a video display and/or reels to present wagering games such as slots, video card games (poker, blackjack etc.), video keno, video bingo, video pachinko and other games available in the gaming industry. Such machines may form part of a wagering game network of machines and servers. Various peripherals can be coupled to individual wagering game machines to increase the variety of interaction available to players.

BRIEF DESCRIPTION OF THE FIGURES

Embodiments of the invention are illustrated by way of example and not limitation in the Figures of the accompanying drawings in which.

DESCRIPTION OF THE EMBODIMENTS

Example Operating Environment

Example Wagering Game Machine Architecture

Figure 1:
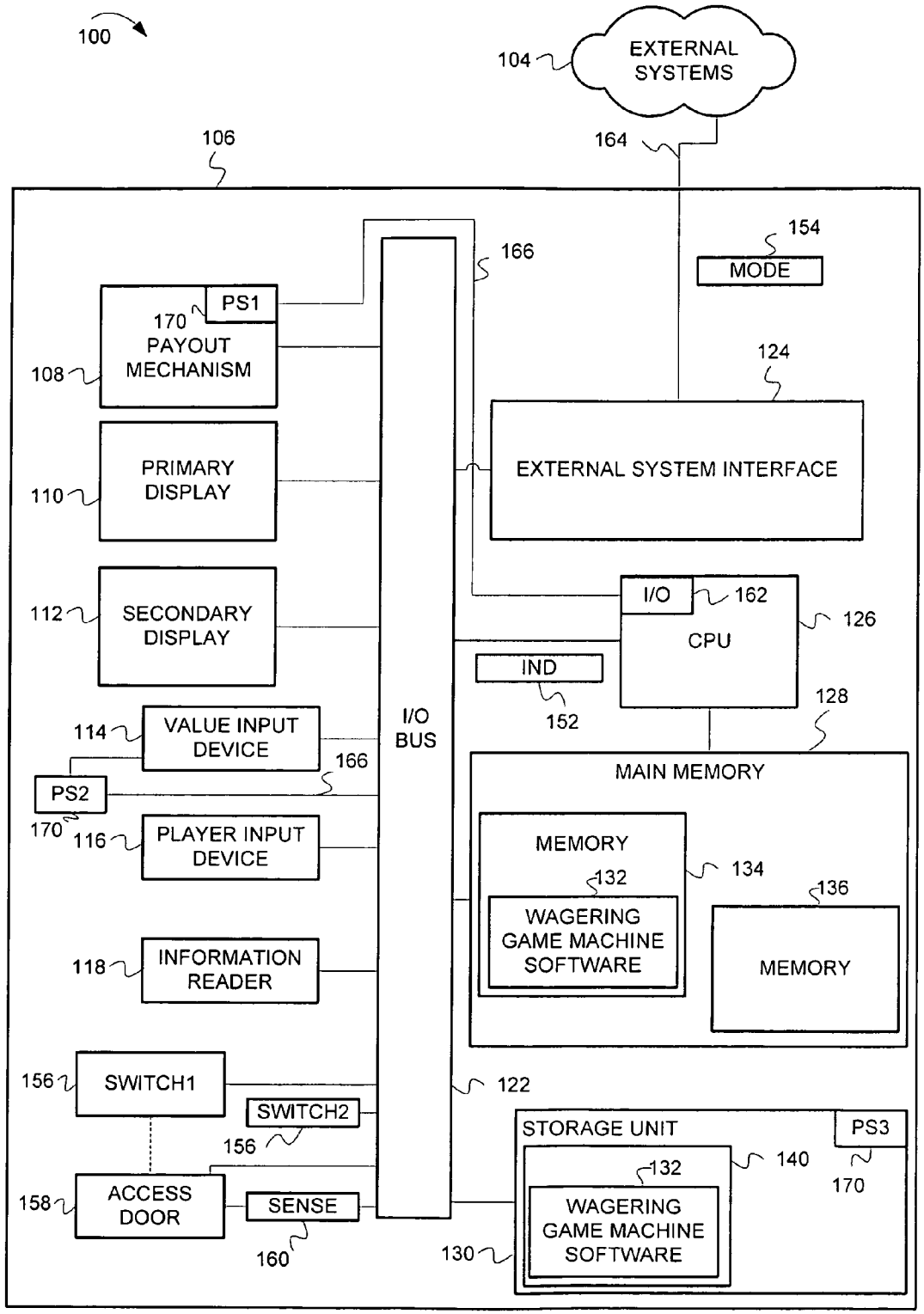
FIG. 1 is a block diagram illustrating a wagering game machine architecture according to various embodiments.

As is the case with many electro-mechanical items, or devices that makes use of consumables, wagering game machines and their associated peripherals sometimes require service. Usually, power to the machine being serviced is turned off. Once service is completed, the machine is turned on and a processor reset operation (sometimes known as "rebooting") occurs, followed by memory content validation. This process may take quite some time, and game play is disabled until validation is complete. Sometimes, because of the long reboot time, service technicians neglect to turn off the machine's power prior to servicing it, which can lead to safety issues.

The inventors have discovered that this problem, as well as others presented by the long reboot time, can be addressed by separating the application of power to various components within the machine, so that a machine selected for service is only partially-powered. That is, full operational power may be selectively applied to certain component within the machine (e.g., the central processor, memory, and touch screen), while the remainder of the machine components remain unpowered. In this way, the machine can enter a special operational mode so that most, if not all components may be safely serviced.

Many embodiments can be realized. For example, a machine that provides this special mode of operation, or "SERVICE power" mode might include a single power supply having switchable sections, or multiple, independently addressable supplies coupled to selected components. In most embodiments, individual supply sections or entire supplies may then be turned on/off, and/or current pathways from selected supplies may be interrupted using switching or power routing arrangements.

A multi-position switch on the machine housing might include a separate SERVICE power mode position to indicate that the SERVICE power mode should be initiated. Then, after service is complete, component power can be re-supplied, and the machine can be returned to the fully operational or ON power mode without a reboot or processor reset operation.

For the purposes of this document, the "OFF power mode" is a wagering game machine mode of operation where game play is disabled, and no processors in the wagering game machine are fully operational. Thus, in the OFF power mode, wagering game machine processors are either off, or in a sleep mode. Transitioning from the OFF power mode into the ON power mode results in rebooting the wagering game machine.

The "ON power mode" is a wagering game machine mode of operation where game play is enabled. The ON power mode includes operations where all components of the machine receive power in the usual fashion. The "LATCHED power mode" is similar in that all components of the machine receive power in the usual fashion. However, in the LATCHED power mode there is additionally some indication that special access to the machine is underway (e.g., service is being performed). For example, this mode may be entered in some embodiments by placing an access door switch in a maintained action mode, which in turn indicates special access has occurred, or is occurring.

The "SERVICE power mode" is a wagering game machine mode of operation where game play is disabled, while substantially uninterrupted power is supplied to a subset of game machine components, including at least one processor and a memory coupled to the processor. In the SERVICE power mode, the remainder of game machine components are left unpowered, and a later transition to the ON power mode from the SERVICE power mode does not reset the processor(s) that continue to receive power. In other words, the processor(s) that continue to receive power in the SERVICE power mode are fully operational, and do not enter a sleep mode, so that rebooting a machine that transitions from the SERVICE power mode to the ON power mode is unnecessary. The SERVICE power mode facilitates troubleshooting, repair, and update operations (e.g., to update or add plug and play peripherals to the wagering game machine). Examples of various embodiments will now be described in combination with the figures in further detail below.

FIG. 1 is a block diagram illustrating a wagering game machine architecture 100 according to various embodiments of the invention. As shown in FIG. 1, an apparatus 106, such as a wagering game machine, includes one or more processors, such as a central processing unit (CPU) 126 connected to main memory 128, which in turn may include wagering game machine software 132. The CPU 126 may include input/output (I/O) ports 162, multiple processing cores, a universal serial bus (USB) peripheral controller, and other elements.

The main memory 128 may be subdivided into portions, such as a first portion memory 134 and second portion memory 136. Each of the portions of memory 134, 136 may comprise volatile memory, non-volatile memory, and combinations thereof. Thus, wagering game machine software 132 may be stored in the memory 134, which may take the form, in whole or in part, of non-volatile memory, including FLASH memory, phase-change memory, and read-only memory, among others. In many embodiments, the wagering game machine software 132 is associated with the presentation of a wagering game, and when executed, can be used to present wagering games upon which monetary value may be wagered. Such games include video poker, video black jack, video slots, video lottery, etc.

The wagering game machine software 132 may alternatively, or in addition, be stored in a mass storage unit 130, which may comprise one or more mass storage devices 140, including a disk drive, such as a hard disk drive or an optical disc drive (e.g., a compact disc, read-only memory disc drive), a flash memory drive, or some combination of these.

The CPU 126 may also be connected to an I/O bus 122, which facilitates communication between the components of the apparatus 106. The I/O bus 122 is connected to a payout mechanism 108, primary display 110, secondary display 112, value input device 114, player input device 116, information reader 118, and storage unit 130. The bus 122 may include one or more portions, any one or more of which may comprise a universal serial bus (USB). Thus, any of the components coupled to the bus 122 may comprise USB peripherals. For specific information regarding the USB protocol, the reader is encouraged to consult the Universal Serial Bus Specification Version 2.0 (2000), published by USB-IF; 5440 SW Westgate Drive, Suite 217; Portland, Oreg. 97221, and amendments thereto, all incorporated herein by reference.

The player input device 116 can include the value input device 114 to the extent the player input device 116 is used to place wagers. The I/O bus 122 may be connected to an external system interface 124, which can be coupled to external systems 104 (e.g., wired and wireless wagering game networks). The external system interface 124 may comprise a network interface card for use with wired networks 164, and/or a wireless transceiver that enables the apparatus 106 to communicate with wireless networks 164. Thus, the apparatus 106 may comprise a portable wagering game machine having a wireless transceiver.

In some embodiments, the apparatus 106 can include additional peripheral devices and/or more than one of each component shown in FIG. 1. For example, the apparatus 106 can include multiple external system interfaces 124 and multiple processors 126. In some embodiments, any of the components can be integrated or subdivided. Additionally, in some embodiments, the components of the apparatus 106 can be interconnected according to any suitable interconnection architecture (e.g., directly connected, serially connected, star network, hypercube, etc.).

In some embodiments, any of the components of the apparatus 106 can include hardware, firmware, and/or software for performing the operations described herein. Thus, some embodiments may include an article comprising a machine readable medium (e.g., memory 128) having instructions stored thereon, wherein the instructions, when executed by one or more processors, result in performing any of the methods described herein. Machine-readable media includes any mechanism that provides (e.g., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory drives, etc. Thus, many embodiments may be realized.

For example, an apparatus 106, perhaps forming part of a wagering game machine, may comprise one or more processors 126 and a software program 132 which, when executed by the processor(s) 126, is associated with presenting a wagering game upon which monetary value may be wagered.

In some embodiments, the apparatus 106 may comprise a wagering game machine having ON, OFF, and SERVICE power modes. As noted previously, the SERVICE power mode operates to disable game play while providing substantially uninterrupted power to a subset of game machine components, including at least one processor and a memory coupled to the processor.

The subset of game machine components selected to receive uninterrupted power may include the CPU 126, the memory 128, the payout mechanism 108, and the value input device 114, for example. In some embodiments, the subset of game machine components may include one or more user input devices 116 (e.g., perhaps used to enter diagnostic information) and one or more display devices 110, 112 (e.g., used to display the diagnostic information). In this way, a user input device 116 can be used to enter diagnostic information during service operations. The user input device 116 and the display 110 may be combined to form a touch screen in some embodiments.

Apart from the subset of powered components, the remainder of the game machine components may be left unpowered in the SERVICE power mode. In this way, the CPU 126 remains fully operational, and is not reset when the machine transitions from the SERVICE power mode to the ON power mode.

To initiate entry into the SERVICE power mode, a number of mechanisms may be employed. For example, the apparatus 106 may include a door position sensor 160 to provide an indication 152 that initiates entry into the SERVICE power mode. The sensor 160 may comprise a multiple-position sensor, such as a sensor that indicates an access door 158 is either closed or open. Thus, the sensor 160 may be used to initiate entry into the ON power mode as well. For example, opening the access door 158 after it has been closed can initiate entry into the SERVICE power mode, and closing the access door 158 after it has been opened can initiate entry into the ON power mode.

Some embodiments may include a LATCHED power mode that permits servicing the machine while machine components continue to receive power—in the same way that power is supplied when the machine is in the ON power mode. The LATCHED power mode facilitates servicing components while power is applied to them, such as ticket printers and the like, so that an access door, for example, can remain open while the machine is fully operational. Thus, to enter into the LATCHED power mode, the access door 158 used for service is typically left open, while the switch SWITCH1 used to sense the door 158 position is placed in a specially-designated (e.g., maintained action0 position.

For example, the switch SWITCH1 may comprise what is known in the industry as a "cheat-interlock" switch, similar to or identical to the E78-30A double-pole, double-throw panel mount pushbutton switch available from the Cherry Corporation of Pleasant Prairie, Wis. in the United States. This particular switch is a dual function switch: it is pushed in to operate in normal momentary mode and pulled out for maintained action (which obviates the need for continued activation of the momentary mode). The apparatus 106 that uses this type of switch SWITCH1 can enter the ON power mode when the access door 158 is closed, the SERVICE power mode when the door 158 is open, and the LATCHED power mode when the door 158 is open and the switch actuator is manually pulled out into a third, maintained action position. When this embodiment is implemented, the apparatus 106 comprises a multi-position switch SWITCH1 that selectively enables the ON, SERVICE, and LATCHED power modes.

In some embodiments, the apparatus 106 may comprise a multi-position switch 156 to provide an indication 152 that selectively enables the ON, SERVICE, and OFF power modes. The switch 156 may therefore comprise a three position switch, and include additional positions to initiate entry into other operational modes, such as the LATCHED power mode, and/or some other power mode. The switch 156 may also take the form of a processor access switch to initiate a transition from the ON power mode to the SERVICE power mode, where any physical access to the CPU 126 transitions the apparatus 106 to the SERVICE power mode.

Switches 156 may also be used in stages. That is, some embodiments of the apparatus 106 may include the use of a first power switch SWITCH1 to initiate entry into the ON power mode and the OFF power mode (e.g., SWITCH1 may comprise a two-position switch having "ON" and "OFF" positions). In this case, a second power switch SWITCH2, separate from the first power switch SWITCH1, can be used to initiate entry into the SERVICE power mode, such that the SERVICE power mode can only be entered when entry into the ON power mode has already been enabled by the first power switch SWITCH1.

Once entry into the SERVICE power mode is initiated, power supplied to various components of the apparatus 106 can be removed. This may be accomplished in a number of ways. For example, the apparatus 106 may include one or more power command communication conduits 166 coupled to one or more CPUs 126 to remove power from the remainder of the game machine components. In this way, the CPU 126 controls the application of power to non-powered components during service operations. The conduits 166 may comprise a signal line (e.g., bus signal or direct connection), a serial communications line (e.g., USB), a wireless connection, or some other type of communications channel.

Components may be turned off, or remain powered, using power supplies 170 that are integral to the components (e.g., power supplies PS1, PS3) or separate from the components (e.g., power supply PS2). The power supplies 170 may comprise sections of a single, physical supply, or be made up of separate supplies, or both. The power supplies 170 may comprise alternating current (AC) supplies, direct current (DC) supplies, or some combination of these.

In some embodiments, power may be controlled by disabling/enabling I/O ports 162 of the CPU 126. The I/O ports 162 may also be disabled/enabled apart from power control during activities forming part of entry into the SERVICE power mode. Entry into the SERVICE power mode may be indicated to other machines or systems via the external system interface 124, perhaps by sending an operational mode indication 154 to other systems 104 via the network 164.

Figure 2:
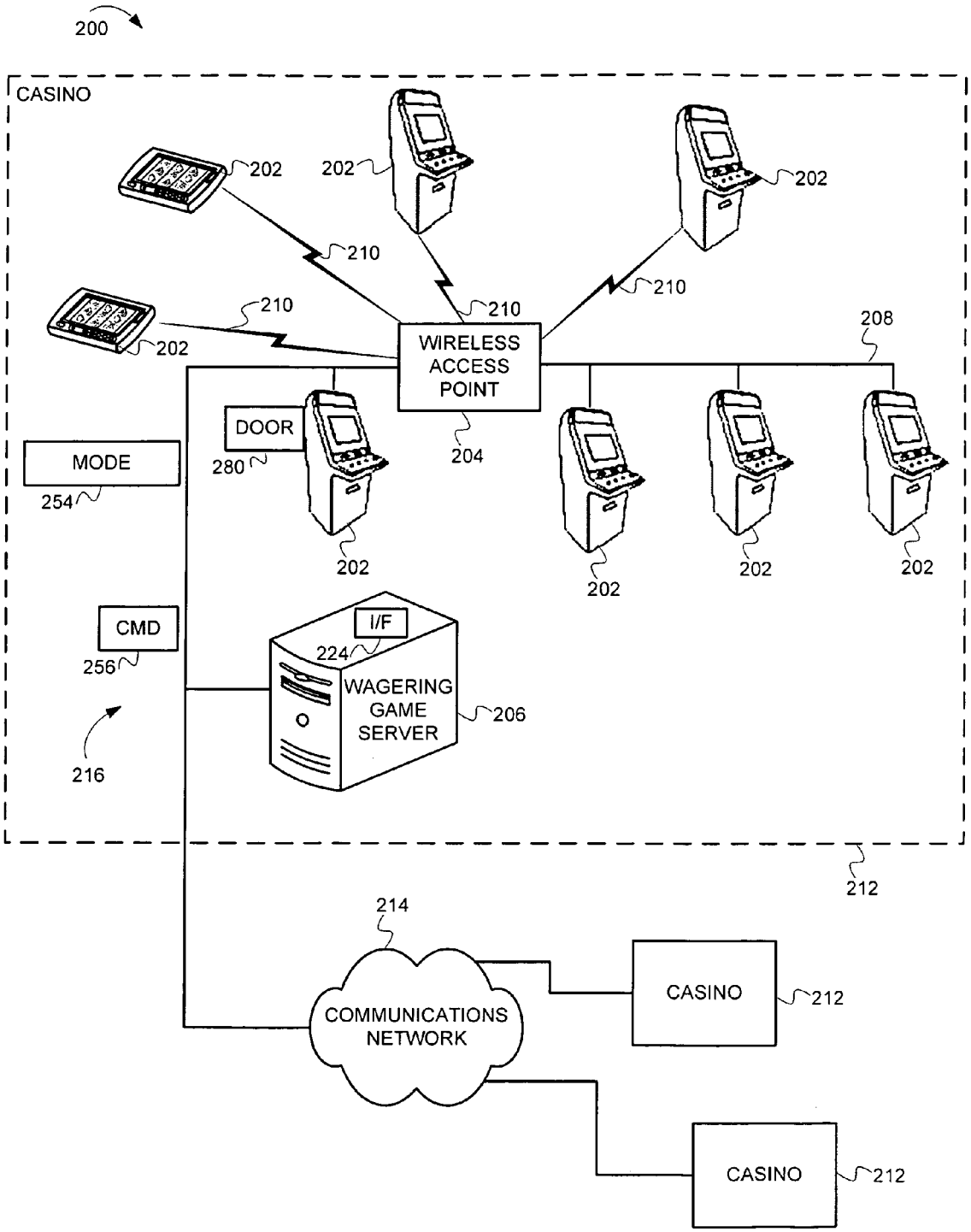
FIG. 2 is a block diagram illustrating a wagering game network, according to various embodiments.

While FIG. 1 describes several embodiments of a wagering game machine architecture, FIG. 2 shows how a plurality of wagering game machines can be connected in a wagering game network.

Example Wagering Game Network

FIG. 2 is a block diagram illustrating a wagering game network 200, according to various embodiments of the invention. As shown in FIG. 2, the wagering game network 200 includes a plurality of casinos 212 connected to a communications network 214.

Each of the plurality of casinos 212 includes a local area network 216, which may include a wireless access point 204, wagering game machines 202, and a wagering game server 206 that can serve wagering games over the local area network 216. As such, the local area network 216 includes wireless communication links 210 and wired communication links 208. The wired and wireless communication links can employ any suitable connection technology, such as Bluetooth, 802.11, Ethernet, public switched telephone networks, SONET, etc. In one embodiment, the wagering game server 206 can serve wagering games and/or distribute content to devices located in other casinos 212 or at other locations on the communications network 214.

The wagering game machines 202 and wagering game server 206 can include hardware and machine-readable media including instructions for performing the operations described herein. The wagering game machines 202 may be similar to or identical to the apparatus 106 shown in FIG. 1.

The wagering game machines 202 described herein can take any suitable form, such as floor standing models, handheld mobile units, bartop models, workstation-type console models, etc. Further, the wagering game machines 202 can be primarily dedicated for use in conducting wagering games, or can include non-dedicated devices, such as mobile phones, personal digital assistants, personal computers, etc. In one embodiment, the wagering game network 200 can include other network devices, such as accounting servers, wide area progressive servers, and player tracking servers.

In various embodiments, wagering game machines 202 and wagering game servers 206 work together such that a wagering game machine 202 may be operated as a thin, thick, or intermediate client. For example, one or more elements of game play may be controlled by the wagering game machine 202 (client) or the wagering game server 206 (server). Game play elements may include executable game code, lookup tables, configuration files, game outcome, audio or visual representations of the game, game assets or the like. In a thin-client example, the wagering game server 206 may perform functions such as determining game outcome or managing assets, while the wagering game machine 202 may be used merely to present the graphical representation of such outcome or asset modification to the user (e.g., player). In a thick-client example, game outcome may be determined locally (e.g., at the wagering game machine 202) and then communicated to the wagering game server 206 for recording or managing a player's account.

Similarly, functionality not directly related to game play may be controlled by the wagering game machine 202 (client) or the wagering game server 206 (server) in some embodiments. For example, power conservation controls that manage a display screen's light intensity may be managed centrally (e.g., by the wagering game server 206) or locally (e.g., by the wagering game machine 202). Other functionality not directly related to game play may include presentation of advertising, software or firmware updates, system quality or security checks, etc.

Thus, other embodiments may be realized. For example, a wagering game system may comprise one or more wagering game machines 202, each of which may be configured to operate in a manner similar to or identical to the apparatus 106 of FIG. 1. That is, a system may include wagering game machines 202 having ON, OFF, and SERVICE power modes. The system may further include one or more wagering game machine servers 206 to detect entry into the SERVICE power mode by the wagering game machines 202.

The system may include a network interface (I/F) 224 to transmit an indication 254 of the entry into the SERVICE power mode. The I/F 224 that communicates entry into the SERVICE power mode (and perhaps other modes, such as the ON power mode and the OFF power mode) over a network 214, for example, can be located in one of the machines 202 (e.g., see I/F 124 in FIG. 1), the servers 206, or both. The system may also include a network I/F (e.g., interface 124 of FIG. 1) in the wagering game machines 202 to receive a command, such as a mode command 256 to enter into the SERVICE power mode. In this way, the machines 202 can be commanded to enter into the SERVICE power mode remotely, over the network 214.

Example Operations

Figure 3:
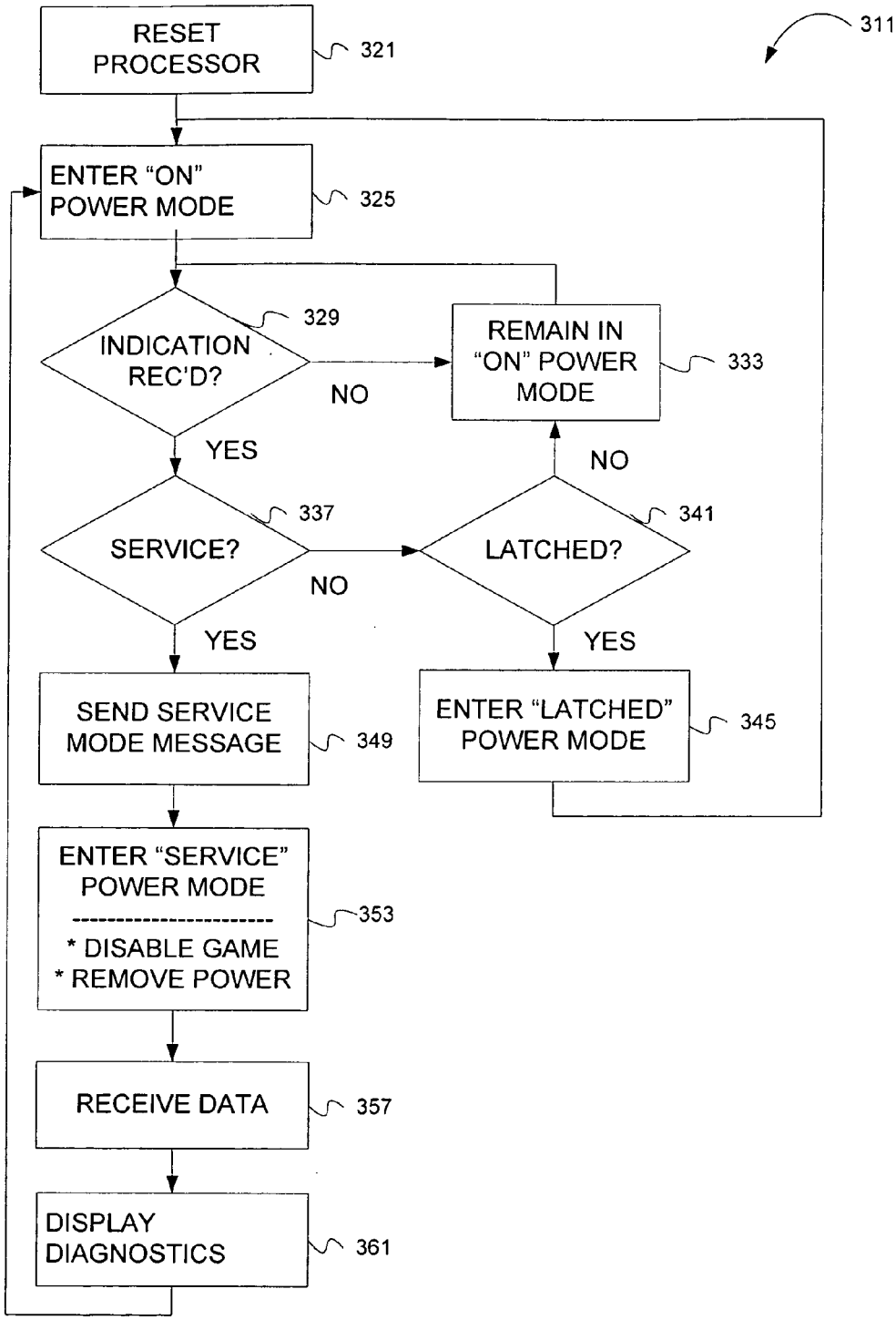
FIG. 3 is a flow chart illustrating methods according to various embodiments.

FIG. 3 is a flow chart illustrating methods 311 according to various embodiments of the invention. In some embodiments, a method 311 that operates to enable transition to and from a SERVICE power mode without rebooting a wagering game machine may begin at block 321 with resetting one or more processors, such as might occur prior to entering the ON power mode from an OFF power mode.

The method 311 may continue with entering the ON power mode at block 325, including validating memory content and enabling game play. If no indication of a mode transition is received at block 329, then the method 311 may include remaining in the ON power mode at block 333.

If an indication of a mode transition is received at block 329, then the method 311 may continue on to block 337 with determining whether entry into the SERVICE power mode is indicated. If not, then the method 311 may continue on to block 341 to determine whether entry into a LATCHED power mode is indicated. If not, then the method 311 may continue with remaining in the ON power mode at block 333.

If entry into the LATCHED power mode is indicated at block 341, then the method 311 may include, at block 345, entering the LATCHED power mode to supply operational power to all game machine components responsive to detecting a latched position (e.g., specially-designated or maintained action position) associated with one or more switches attached to the game machine. Thus, in some embodiments, the machine may enter into the SERVICE power mode when an access door is opened, the ON power mode when door is closed, and the LATCHED power mode when a switch is in a maintained action position, so that all components can receive power (e.g., those that might normally be unpowered in the SERVICE power mode) to facilitate performing certain kinds of service, such as loading paper into a printer or doing a printer test. As noted previously, in some embodiments, the LATCHED power mode may be entered by activating a cheat-interlock switch, or some other switch or sensor that operates to indicate that extended service operations are desired, and all of the remaining components that usually remain unpowered in the SERVICE power mode are to receive full power. Transition into and out of the LATCHED power mode from the ON power mode does not typically result in rebooting the wagering game machine.

The method 311 may include receiving an indication that the wagering game machine is to enter a SERVICE power mode while the game machine is in an ON power mode. Receiving the indication at block 337 may comprise detecting operation of a cabinet door attached to the game machine, so that game machine cabinet access can initiate entry into the SERVICE power mode. Receiving the indication may also comprise receiving a signal from a multi-position power switch having positions associated with the ON power mode, the SERVICE power mode, and an OFF power mode, among others, so that a single switch can be used to turn the machine on and off, as well as to provide service.

In some embodiments, the method 311 may include receiving the indication for entry into the SERVICE power mode when a power switch is selectively manipulated. For example, the indication may be received from a spring-loaded switch when the switch has been maintained in a depressed position (e.g., activated) for a specified length of time (e.g., some number of seconds). The switch may be configured to return to a non-depressed, or deactivated position from the activated position when not maintained in the activated position by a user. That is, depressing a push-button switch for several seconds can permit entry into the SERVICE power mode, while continuously depressing the switch for a longer time period can place the machine in the OFF power mode. Thus, if the switch is depressed for three seconds, for example, the machine may enter the SERVICE power mode, but if the switch is depressed for eight seconds, the machine may enter the OFF power mode (with or without first entering into the SERVICE power mode). Other time periods and arrangements may be used.

In some embodiments, the indication to enter the SERVICE power mode may be provided by selective manipulation of one or more wagering game machine user input devices. Thus, the method 311 may include receiving the indication as a result of user input device manipulation on the wagering game machine. Some unique combination of user input device activation, such as holding down a "fire" button while moving a joystick through two full counter-clockwise rotations, for example, might result in SERVICE power mode initiation. Other combinations may also be selected.

If entry into the SERVICE power mode is indicated at block 337, then the method 311 may include sending a message that this mode has been entered (or is about to be entered) at block 349. That is, the method 311 may include, prior to entering the SERVICE power mode, using a network interface to communicate entry, or imminent entry into the SERVICE power mode. In this way, other wagering game machines and/or servers can be informed of the service status of various machines on the network.

The method 311 may continue on to block 353 with entering the SERVICE power mode to disable game play while providing substantially uninterrupted power to a subset of game machine components including one or more processors and memory coupled to the processor(s). The processor(s) may include I/O ports, and one or more of these I/O ports can also be disabled in the SERVICE power mode.

Entering into the SERVICE power mode may comprise applying a disable power command originating from the processor(s) to one or more power supplies to remove power from the remainder of the game machine components. In this way, the processor(s) operate to disable power to other components during the SERVICE power mode. Entering into the SERVICE power mode may also comprise removing AC power to at least some of the remainder of the game machine components (e.g., perhaps by disabling one or more AC supply control conduits within the wagering game machine). Thus, AC power to some components may be removed, while being left on for others (e.g., a service lamp connected to unswitched AC supply).

The method 311 may continue on to block 357 with receiving data from a user input device while in the SERVICE power mode, and then on to block 361 where, responsive to receiving the data, the method 311 may include displaying diagnostic information on a gaming display coupled to the wagering game machine in a human-readable format. In this way, direct diagnostic communication with a service technician can be enabled during the SERVICE power mode. For example, the method 311 may include providing operational power to a subset of the wagering game machine components in the SERVICE power mode, wherein the subset comprises a display screen and a user input device.

It should be noted that unless specifically claimed otherwise, the methods described herein do not have to be executed in the order described, or in any particular order. Moreover, various activities described with respect to the methods identified herein can be executed in iterative, repetitive, serial, or parallel fashion. Information, including parameters, commands, operands, and other data, can be sent and received in the form of one or more carrier waves.

Example Wagering Game Machines

Example Wagering Game Machine

Figure 4:
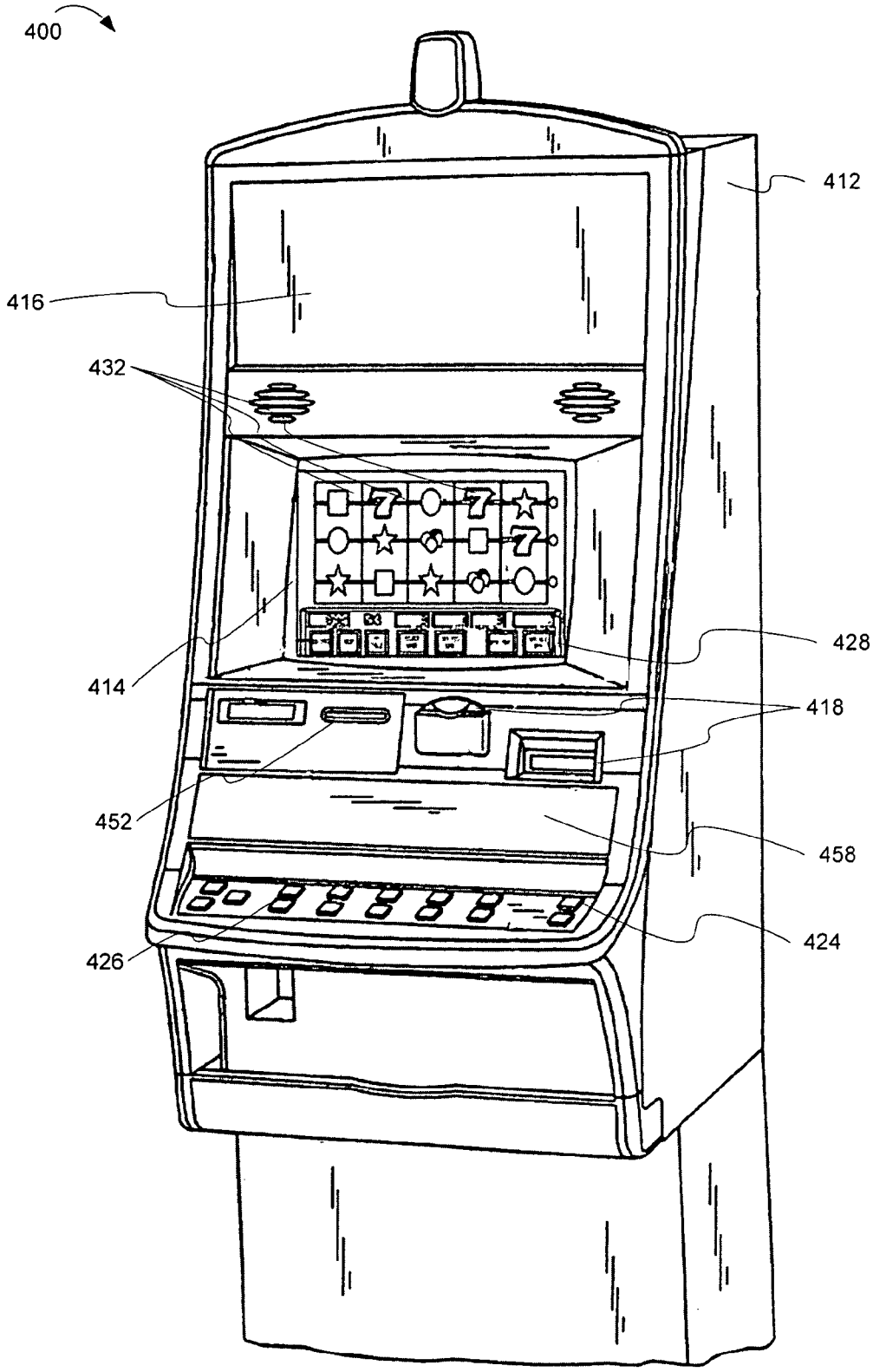
FIG. 4 is a perspective view of a wagering game machine, according to various embodiments.

FIG. 4 is a perspective view of a wagering game machine 400, according to various embodiments of the invention. Referring to FIG. 4, a wagering game machine 400 is used in gaming establishments, such as casinos. According to most embodiments, the wagering game machine 400 can be any type of wagering game machine and can have varying structures and methods of operation. For example, the wagering game machine 400 can be an electromechanical wagering game machine configured to play mechanical slots, or it can be an electronic wagering game machine configured to play video casino games, such as blackjack, slots, keno, poker, blackjack, roulette, etc. The wagering game machine 400 may include one or more of the apparatus 106 of FIG. 1, and may be used in a network in the same was as the machines 202 of FIG. 2.

The wagering game machine 400 comprises a housing 412 and includes input devices, including value input devices 418 and a player input device 424. For output, the wagering game machine 400 includes a primary display 414 for displaying information about a basic wagering game. The primary display 414 can also display information about a bonus wagering game and a progressive wagering game. The wagering game machine 400 also includes a secondary display 416 for displaying wagering game events, wagering game outcomes, and/or signage information. While some components of the wagering game machine 400 are described herein, numerous other elements can exist and can be used in any number or combination to create varying forms of the wagering game machine 400.

The value input devices 418 can take any suitable form and can be located on the front of the housing 412. The value input devices 418 can receive currency and/or credits inserted by a player. The value input devices 418 can include coin acceptors for receiving coin currency and bill acceptors for receiving paper currency. Furthermore, the value input devices 418 can include ticket readers or barcode scanners for reading information stored on vouchers, cards, or other tangible portable storage devices. The vouchers or cards can authorize access to central accounts, which can transfer money to the wagering game machine 400.

The player input device 424 comprises a plurality of push buttons on a button panel 426 for operating the wagering game machine 400. In addition, or alternatively, the player input device 424 can comprise a touch screen 428 mounted over the primary display 414 and/or secondary display 416.

Selective manipulation of the player input device 424 may cause entry into the SERVICE power mode. For example in the case of the machine 400 shown, it may be that the sequence of simultaneously activating all odd buttons of the device 424 for at least five seconds, then simultaneously activating the even buttons for another five seconds, and then activating the odd buttons again will cause the machine 400 to enter into the SERVICE power mode.

The various components of the wagering game machine 400 can be connected directly to, or contained within, the housing 412. Alternatively, some of the wagering game machine's components can be located outside of the housing 412, while being communicatively coupled with the wagering game machine 400 using any suitable wired or wireless communication technology. A service access door 458 may be used to initiate entry into the SERVICE power mode.

The operation of the basic wagering game can be displayed to the player on the primary display 414. The primary display 414 can also display a bonus game associated with the basic wagering game. The primary display 414 can include a cathode ray tube (CRT), a high resolution liquid crystal display (LCD), a plasma display, light emitting diodes (LEDs), or any other type of display suitable for use in the wagering game machine 400. Alternatively, the primary display 414 can include a number of mechanical reels to display the outcome. In FIG. 4, the wagering game machine 400 is an "upright" version in which the primary display 414 is oriented vertically relative to the player. Alternatively, the wagering game machine can be a "slant-top" version in which the primary display 414 is slanted at about a thirty-degree angle toward the player of the wagering game machine 400. In yet another embodiment, the wagering game machine 400 can exhibit any suitable form factor, such as a free standing model, bartop model, mobile handheld model, or workstation console model.

A player begins playing a basic wagering game by making a wager via the value input device 418. The player can initiate play by using the player input device's buttons or touch screen 428. The basic game can include arranging a plurality of symbols along a payline 432, which indicates one or more outcomes of the basic game. Such outcomes can be randomly selected in response to player input. At least one of the outcomes, which can include any variation or combination of symbols, can trigger a bonus game.

In some embodiments, the wagering game machine 400 can also include an information reader 452, which can include a card reader, ticket reader, bar code scanner, RFID transceiver, or computer readable storage medium interface. In some embodiments, the information reader 452 can be used to award complimentary services, restore game assets, track player habits, etc.

General

Implementing the apparatus, systems, and methods disclosed herein may provide wagering game machines that can be serviced while selected components remain fully operational. Not only is this type of service environment more flexible, it may be safer. In most cases, machines that make use of the various embodiments may be rapidly returned to service, so that increased player satisfaction, as well as additional revenue for owners of the machines, is realized.

In this detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments.

Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Description of the Embodiments, it can be seen that various features are grouped together in a single embodiment for the purpose of streamlining the disclosure. This method of disclosure is not to be interpreted to require more features than are expressly recited in each claim. Rather, inventive subject matter may be found in less than all features of a single disclosed embodiment. Thus the following claims are hereby incorporated into this detailed description, with each claim standing on its own as a separate embodiment.

What is claimed is:

1. A method, comprising:

receiving an indication that a wagering game machine is to enter a SERVICE power mode while the game machine is in an ON power mode; and entering the SERVICE power mode to disable game play while providing substantially uninterrupted power to a subset of game machine components including at least one processor and a memory coupled to the processor, and to leave unpowered a remainder of the game machine components, wherein later transitioning from the SERVICE power mode to the ON power mode does not reset the at least one processor.

2. The method of claim 1, comprising:

receiving data from a user input device while in the SERVICE power mode; and responsive to receiving the data, displaying diagnostic information on a gaming display coupled to the wagering game machine in a human-readable format.

3. The method of claim 1, wherein receiving the indication comprises:

detecting operation of a cabinet door attached to the game machine or detecting user input device manipulation on the wagering game machine.

4. The method of claim 1, wherein receiving the indication comprises:

receiving a signal from a multi-position power switch having positions associated with the ON power mode, the SERVICE power mode, and an OFF power mode.

5. The method of claim 1, comprising:

receiving the indication from a spring-loaded switch that the switch has been maintained in a second position for a specified length of time, wherein the switch is configured to return to a first position from the second position when not maintained in the second position by a user.

6. The method of claim 1, wherein the at least one processor includes input/output ports, and wherein some of the input/output ports are disabled in the SERVICE power mode.

7. The method of claim 1, wherein entering the SERVICE power mode comprises:

removing alternating current power to at least some of the remainder of the game machine components.

8. The method of claim 1, comprising:

applying a disable power command originating from the at least one processor to one or more power supplies to remove power from the remainder of the game machine components.

9. The method of claim 1, comprising:

entering a LATCHED power mode to supply operational power to all of the game machine components responsive to detecting a latched position associated with at least one switch attached to the game machine.

10. The method of claim 1, further comprising:

prior to entering the SERVICE power mode, using a network interface to communicate imminent entry into the SERVICE power mode.

11. An apparatus, comprising:

a wagering game machine having ON, OFF, and SERVICE power modes, wherein the SERVICE power mode is to disable game play while providing substantially uninterrupted power to a subset of game machine components including at least one processor and a memory coupled to the processor, and to leave unpowered a remainder of the game machine components, wherein later transitioning from the SERVICE power mode to the ON power mode does not reset the at least one processor.

12. The apparatus of claim 11, comprising:

a door position sensor to provide an indication to initiate entry into the SERVICE power mode, and to initiate entry into the ON power mode.

13. The apparatus of claim 11, comprising:

a multi-position switch to selectively enable the ON, OFF, and SERVICE power modes.

14. The apparatus of claim 11, comprising:

a processor access switch to initiate a transition from the ON power mode to the SERVICE power mode.

15. The apparatus of claim 11, wherein the subset of game machine components includes at least one user input device to enter diagnostic information and one display device to display diagnostic information.

16. The apparatus of claim 11, comprising:

a power command communication conduit coupled to the at least one processor to remove power from the remainder of the game machine components.

17. The apparatus of claim 11, comprising:

a first power switch to initiate the ON and the OFF power modes; and a second power switch separate from the first power switch to initiate the SERVICE power mode, wherein the SERVICE power mode can only be initiated when the ON power mode has been initiated by the first power switch.

18. A system, comprising:

a wagering game machine having ON, OFF, and SERVICE power modes, wherein the SERVICE power mode is to disable game play while providing substantially uninterrupted power to a subset of game machine components including at least one processor and a memory coupled to the processor, and to leave unpowered a remainder of the game machine components, wherein later transitioning from the SERVICE power mode to the ON power mode does not reset the at least one processor; and a wagering game machine server to detect entry into the SERVICE power mode by the wagering game machine.

19. The system of claim 18, comprising:

a network interface to transmit an indication of the entry into the SERVICE power mode.

20. The system of claim 18, comprising:

a network interface in the wagering game machine to receive a command to enter into the SERVICE power mode.

* * * * *